US008904908B1

(12) United States Patent
Luhman

(10) Patent No.: US 8,904,908 B1
(45) Date of Patent: Dec. 9, 2014

(54) RATCHETING OPEN END WRENCH

(75) Inventor: John Richard Luhman, Traer, IA (US)

(73) Assignee: Toolsmart, LLC, Norman, OK (US)

( * ) Notice: Subject to any disclaimer, the term of this patent is extended or adjusted under 35 U.S.C. 154(b) by 246 days.

(21) Appl. No.: 13/562,856

(22) Filed: Jul. 31, 2012

Related U.S. Application Data

(60) Provisional application No. 61/575,589, filed on Aug. 1, 2011.

(51) Int. Cl.
*B25B 13/46* (2006.01)
*B25B 13/08* (2006.01)
*B25B 13/04* (2006.01)

(52) U.S. Cl.
USPC ..... 81/92

(58) Field of Classification Search
USPC ..... 81/92, 58, 186
See application file for complete search history.

(56) References Cited

U.S. PATENT DOCUMENTS

| | | | | |
|---|---|---|---|---|
| 1,406,755 | A * | 2/1922 | Peters | 81/92 |
| 1,661,229 | A * | 3/1928 | Montgomery | 81/92 |
| 2,447,835 | A * | 8/1948 | Beard | 81/92 |
| 2,514,687 | A * | 7/1950 | Werner | 81/111 |
| 2,602,362 | A | 7/1952 | Johns | |
| 7,418,891 | B2 * | 9/2008 | Choi | 81/98 |

* cited by examiner

*Primary Examiner* — David B Thomas
(74) *Attorney, Agent, or Firm* — Molly D. McKay

(57) ABSTRACT

An open-end ratcheting tool with handle for rotating hardware located within a circular enclosure of the tool. The void in the tool houses a spring attached to a tang of a pawl for biasing the pivoting pawl toward the hardware. A beveled tip provided on the pawl for engaging the hardware. A stop provided on the body, a notch in the void, and a mating tang on the pawl collectively maintain the off-center characteristic of the pawl and prevent pawl kick out under severe torque demand. An optional opener can be provided for manually drawing the pawl in an open configuration, and an optional center guide-ring can be provided on the inside of the hardware void to position the tool relative to the hardware. An alternate closed end version of the tool can be constructed, and the pawl can be repositioning for use on round hardware.

14 Claims, 3 Drawing Sheets

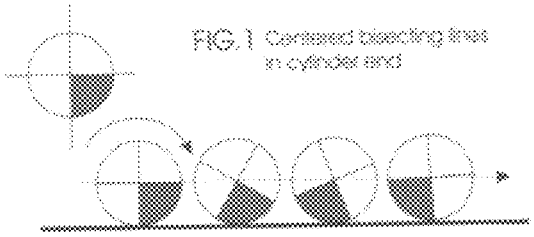
FIG.1 Centered bisecting lines in cylinder end
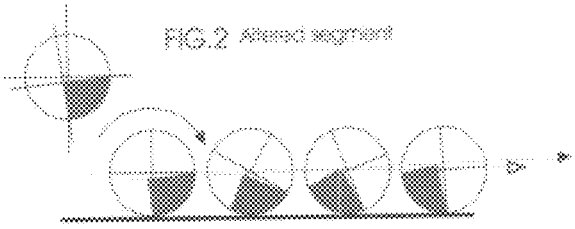
FIG.2 Ahead segment
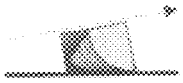
FIG.3 View of resulting action
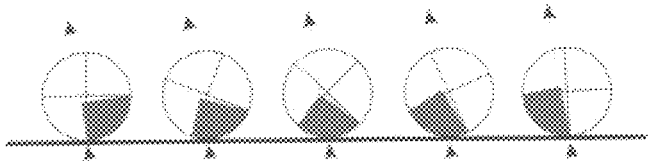
FIG.4
View of the off-center condition throughout a quarter turn
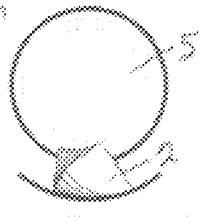
FIG.5 View of the action when applied to a radial baseline as pertains to the tool
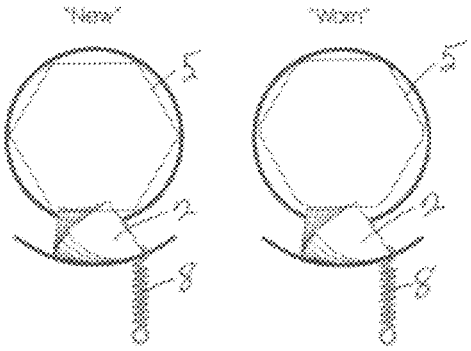
FIG.6
View of the self-adjustment mode under spring load in application upon both new hardware and worn hardware

RATCHETING OPEN END WRENCH

CROSS-REFERENCE TO RELATED APPLICATIONS

The present application claims priority to U.S. Provisional Patent Application No. 61/575,589 for Ratcheting Open End Wrench that was filed on Aug. 1, 2011.

BACKGROUND OF THE INVENTION

1. Field of the Invention

The present invention relates to an open-end wrench utilizing a spring-activated, oscillatable pawl and has for its object and purpose to provide rotation or control of hardware or material. A further object of the invention is to provide said action while also allowing a reliable ratcheting characteristic. An important aspect of this invention resides in the influx of compression and resulting friction to provide such action of rotation or control; with such compression increasing upon demand during operation of the invention with such aspect providing positive control over said hardware or material to the point of reliable function with worn hardware, as well as its application with different shapes of material. The geometry involved in the function of this tool is such as to allow release of this compression during operation, thus providing said ratcheting effect.

2. Description of the Related Art

The original basis of development of this tool was to provide a suitable device as to facilitate the installation or removal of coaxial CATV house wire fittings which utilize 7/16" hex nut hardware. The abbreviation CATV originally stood for Community Access Television or Community Antenna Television and is often used to mean "Cable TV". Due to their configuration in conjunction with coaxial wire, this hardware requires the application of an open-end tool. Although improving speed of handling of such hardware was the inspiration for development of this tool, a multitude of problems inherent to open-end wrenches has been overcome in the process, as will become evident hereafter.

The CATV fittings, in many instances, requires the application of a tool through the entire installation or removal process through 5 to 7 complete revolutions due to friction caused by oxidation of adjoining hardware and use of rubber "boots" to seal out moisture. The positioning of such hardware, located in close proximity to other hardware or material, also necessitates the use of a tool as to manipulate. The common tool of choice is the standard open-end wrench, which, though simple and reliable, requires multiple independent movements to use. To use the standard open-end wrench, it needs to be very deliberately aligned, inserted over the hardware, rotated, removed, and finally re-aligned for each individual movement of the hardware.

There are variations of this standard tool as to minimize these movements, i.e. so called "speed wrenches", which utilize a notched configuration to minimize interference with the hardware on the "return stroke". This allows for a ratcheting effect which works well "on the bench", but when put into practice, functions poorly or intermittently due to the fact that these tools must be deliberately maintained at a 90 degree position to the hardware to function. When such tools are applied as a fitting wrench, the difficulty of this aspect is magnified due the simple fact that fittings are "free standing", i.e. there is no backing surface to serve as a guide to maintain this 90 degree angle. The result is frequent misalignment equating to the hardware simply moving back and forth with the tool, and the promise of speed quickly transforms into frustration.

Aside from poor handling characteristics, open-end wrenches exhibit another very distinct flaw; this aspect clearly evident upon applying torque. Due the fact that these tools utilize the specific shape of the hardware to function, i.e. the "flat" portions of hexagonal hardware, upon applying torque, the holding point of contact is transferred to the weakest point of the structure of the hardware, that being the outermost edges of the hexagonal shape. Compounding this situation is the direction of stress involved, which is radial (rotational). This combination of dynamics creates a diminishing holding point, directly related to the amount of torque applied. This situation severely limits the function of the tool, due to the threat of failure of the hardware (rounding over).

Also, these tools are generally fabricated 'flat', i.e. approximately ⅛" thick, which requires a wide configuration to maintain structural strength. This aspect further limits their use, as clearance becomes an issue.

Some tools incorporate a round hardware enclosure like the present invention. An example of this can be found in U.S. Pat. No. 2,602,362. However, those tools exhibit two very important flaws. The most obvious flaw is the previously described situation concerning applied torque which is magnified due to the utilization of only a single holding point.

The other flaw of those tools is not so obvious, and concerns the implementation of a round void to maintain the relative position of the hardware. More specifically, the round void relies upon the outer circumference of the hardware to provide positioning in relation to its contact point of the pawl. When those tools are applied upon worn hardware with rounded over edges, such hardware finds a location further from its contact point with the pawl, and due the fact that the configuration of the pawl does not compensate for this condition, a poor holding characteristic is further weakened.

This tool addresses all these drawbacks related to open-end wrenches. It does so by employing a round hardware enclosure and utilizing dynamics to transfer rotational energy to an inward compression aspect, with such characteristics to provide function on worn, round, or other shaped material. This compression action provides an extremely positive holding characteristic, while also allowing a consistent ratcheting capability. The present invention is a simple and economical design which utilizes only one moving piece. In short, the present invention is a very dependable tool which handles much as a standard ratcheting socket wrench, with such handling and reliability delivered as to include the benefits of an open-end configuration.

SUMMARY OF THE INVENTION

The present invention is an open-end wrench or tool that utilizes a ratcheting characteristic to allow the tool to manipulate or rotate hardware, such as CATV coaxial fittings, etc.

The tool is comprised of a body and a spring-actuated pawl located within a void in the body. The body includes a handle to manipulate or rotate the tool with a partial enclosure to maintain position of the hardware in relation to the pawl. The void in the body of the tool maintains position and action of the pawl. The body is also provided with an aperture that is continuous with the void to provide positioning of a pawl biasing spring. The pawl spring attaches to a tang of the pawl and biases the pawl toward the aperture which is located in a notch of the void located toward the rear of the pawl void. The tool is also provided with outer shell hardware that encloses the void and the aperture.

In operation, the tool is initially positioned upon the hardware and, with a slight reversal of the handle; the pawl is driven open to allow the tool to find position over the hardware. At this point the pawl establishes initial contact with the hardware via pivoting action. The pivoting action is aided by spring-load provided by the pawl biasing spring. This pivoting action creates a wedging effect of the pawl against the hardware. At this point, a geometrical relationship is established between the point of contact of the pawl against the hardware and the contact area of the base of the pawl which engages a corresponding surface of the void.

To rotate the hardware, a user draws forward upon the handle to rotate the tool around the hardware in a clockwise manner. This is possible due the fact that the hardware enclosure is circular. Thus, the tool can rotate around the hardware free of obstruction. This movement causes the pawl to roll along its base due to the wedging aspect of the contacting tip of the pawl against the hardware. The geometry of all parts involved during this rolling action of the pawl causes the contact point against the hardware to relocate, further pressing inward toward and against the hardware.

Thus an increasing compression aspect is established, forcing the hardware against the inner radius of the partial enclosure until such compression and resulting friction is adequate to hold the hardware in conjunction with the tool, at which point the tool transfers such rotation to the hardware.

Upon satisfactory rotation of the hardware, the movement of the tool is reversed to relocate the tool for another movement of the hardware in a ratcheting action. This reversal of movement causes the pawl to be relieved of its compression by collapsing the pivoting aspect readily achieved by the simple reversal of motion, due to the constant off-center condition of the pawl within the tool. This reverse motion can continue without entraining the hardware due to the light resistance delivered by the pawl spring that spring loads the pawl. Thus, the pawl is rolled back and pivoted over until the contact point of the pawl escapes past the highest point of the hardware. The pawl is then brought back to its engagement with the hardware by way of the spring-load, whereby the process can be repeated. By repeatedly moving the wrench back and forth in this ratcheting manner, the hardware may be located step by step toward a tightening condition.

To loosen the hardware, the wrench is flipped over 180 degrees and applied in a reverse manner to place the wrench in a tightening direction relative to the hardware. The function of the tool is basically the same to loosen the hardware as when tightening the hardware, although the direction of manipulation is reversed.

This tool engages the outer circumference of the hardware to maintain relative position of such hardware as to function. Due to a minimized outer circumference of worn hardware with rounded over lobes and hardware manufactured with rounded lobes, the tool finds a gripping position further away from the pawl on these types of hardware. As such, the initial pivoting action of the pawl falls short of establishing contact with the hardware. This aspect is compensated by the spring which is attached to a tang provided on the pawl which draws the pawl into its compression phase. Thus the contact point of the pawl elevates or advances toward the hardware until the necessary wedging aspect is achieved at which point the tool functions normally.

Under severe torque demand, the pawl may be forced to roll through its entire range of motion, at which point a stop is provided in the body. The stop is configured to maintain the off-center characteristic necessary for release of compression upon ratcheting. In this situation, under continued torque application, the stop becomes a fulcrum against the pawl, and as such, the base is in jeopardy of relocating or kicking out. To prevent kicking out of the pawl and to maintain the desired geometry, a notch is provided in the pawl void of the body so that the notch is located at the end of the radius configuration. The notch and the mating tang fabricated in the base of the pawl function together to allow for positive positioning of the pawl within the tool to maintain functionality.

Due to the extreme upward pressure exerted against the upper surface of partial enclosure of the hardware void, the open-end configuration requires a suitable degree of hardness in the construction material to hold up against such pressure and to maintain the condition of the contact point of the pawl as it relates directly to the function of the tool.

Alternately, a stronger closed end version of the tool can be constructed. This alternate tool could be constructed of softer metal in its fabrication. A narrower (thinner) version is also of consideration, although sacrificing some benefits of handling would result.

A beveled tip of the pawl aids in the initial application of the tool over the hardware. Such a beveled tip facilitates the act of opening the pawl in its initial application, however this beveled tip sacrifices contact point area, and thus can detract from its function.

To assist in the initial application of the tool, an optional manually opener may be provided. The opener employs a spring activated thumb piece with a connection to the pawl that is configured to be independent of the action of the pawl during operation of the tool. To use, the thumb piece is manually drawn downward and this pulls the pawl in an opening manner as to provide clearance of the pawl in relation to the hardware to be manipulated, thus allowing the tool to be more readily installed upon the hardware.

A center guide-ring may be provided in the tool on the inside of the tool within the partial enclosure or within the hardware void on the alternate closed end tool. The center guide-ring is possible due the thick configuration of the tool which allows for a surface to maintain the hardware within the hardware enclosure or void. The center guide-ring functions to improve handling characteristics in both tightening and loosening situations.

A tool configuration can be designed specific as to function on round material or hardware by fabricating the hardware void as to provide suitable guidance of the round hardware material, and also reconfiguring the positioning of the pawl to allow correct location of the pawl, i.e. providing correct initial pivoting/wedging aspects which allows for the complete motion of the pawl to take full advantage of the compression aspect.

BRIEF DESCRIPTION OF THE DRAWINGS

FIG. 1 is a view of quartered cylinder illustrating the intersecting point of such quartering in relation to a baseline, as established by a rolling action of a segment of such cylinder across said baseline.

FIG. 2 is a similar view to FIG. 1 utilizing an altered segmenting, illustrating the resulting change of position.

FIG. 3 is a similar view to FIG. 2 utilizing combined segments illustrated in correct position as to highlight such resulting change of position due to the off center aspect of the altered segment.

FIG. 4 is a similar view to FIG. 2 highlighting the off center characteristic of segments through a quarter turn.

FIG. 5 is a similar view of combined aspects from FIG. 4 as applied to a radial base.

FIG. 6 is a similar view of combined aspects from FIG. 4 illustrating spring load delivered upon such segment, as utilized upon both new and worn hardware.

DETAILED DESCRIPTION OF THE PREFERRED EMBODIMENT

Basic Relevant Geometry

Figure 7:
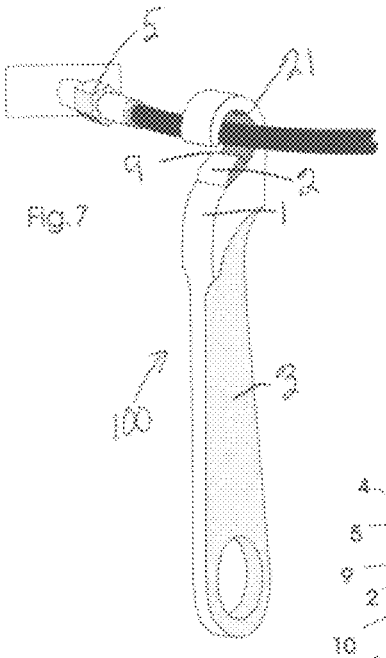
FIG. 7 is a perspective view of a basic ratcheting open end wrench or tool constructed in accordance with a preferred embodiment of the present invention shown with a CATV coaxial wire and related hardware.

A description of the basic geometry involved in the function of this tool is in order prior to discussing the present invention to provide a clear understanding of the dynamics involved. FIGS. 1 through 6 will be used in this description of basic geometry. FIGS. 1-6 can best be understood as end views of a cylinder, with shaded segments representing physical aspects of the present tool 100. More specifically, these figures are meant to illustrate the resulting dynamics concerning the hardware contact point of the pawl 2 of the tool 100, in relation to the baseline provided, as established by a simple rolling action of said cylinder across such baseline.

FIG. 1 illustrates this relationship as presented in a perfectly quartered cylinder. Thus, the center of the cylinder is the point of interest. As the cylinder travels along the illustrated flat baseline, the center of the cylinder, which is shown with curved arrows, shows no change in the distance between the center point of the cylinder in relation to the baseline through a quarter turn of the cylinder.

FIG. 2 illustrates the same action as in FIG. 1 utilizing an altered, off-center segment, and the corresponding action through its rotation along the baseline; of concern again, being the point of contact in relation to said baseline, and the resulting gradual change of the relative distance between the point and the baseline through such action.

FIG. 3 presents the previously described action of such altered segment, utilizing overlapping segments as to provide a more understandable view of the result of such action.

FIG. 4 illustrates the relationship of the contact point with the area of contact of the pawl upon the base, showing the off center configuration which is maintained throughout its motion. Of importance is the fact that the dynamics never reach "top-dead-center" thus avoiding the prospect of the pawl "jamming" under the hardware.

FIG. 5 illustrates the previously described dynamics as applied to a radial base, providing a view of such action in relation to a concentric circle, with such circle representing the hardware enclosure of this tool. The implementation of the radial base provides consistently correct action of such dynamics as related to hardware maintained by such enclosure.

FIG. 6 illustrates the application of the segment in conjunction with a radial base, as utilized upon hardware located in the previously mentioned hardware enclosure, providing a view of this segment under spring-loading as to show the resulting initial contact point upon such hardware of both good condition and hardware in worn condition.

The Invention

Now that the relevant geometry has been described, the present invention relates to an open-end wrench or tool 100 that utilizes a ratcheting characteristic. The object and purpose of the tool 100 is to manipulate or rotate hardware. The following description relates to this tool 100 and its application with hex-shaped hardware, i.e. common nuts or bolts, although the function of this tool is not limited to such specific shapes of hardware. The configuration of the tool allows for an open-end aspect, allowing its application with CATV coaxial fittings, automotive brake line fittings, as well as other situations which require the use of an open end tool.

Figure 11:
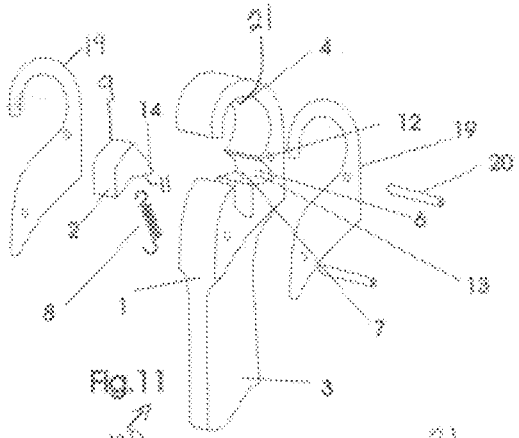
FIG. 11 is an exploded perspective view of the tool of FIG. 7.

Referring to the drawings and initially to FIG. 7, there is illustrated a tool 100 that is constructed in accordance with a preferred embodiment of the present invention. The tool 100 comprises a body 1 and a spring-actuated pawl 2 located within a void 6 in the body 1. The body 1 includes a handle 3 to manipulate or rotate the tool or device 100, with a partial enclosure 4 to maintain position of the hardware 5 in relation to the pawl 2. The void 6 in the body 1 of the tool 100 maintains position and action of the pawl 2. The body 1 is also provided with an aperture 7 that is continuous with the void 6 to provide positioning of a pawl spring 8. The pawl spring biases the pawl 2 toward the aperture 7 which is located toward the rear of the pawl void 6 and causes the pawl 2 to pivot, forcing its contact point 9 upward toward hardware 5 contained within the partial enclosure 4 of the tool 100. As shown in FIG. 11, the tool 100 is also provided with outer shell hardware 19 and fasteners 20 that hold the hardware 19 to the body 1. The outer shell hardware 19 serve to provide side walls to enclose the void 6 and the aperture 7 and to hold the pawl 2 and pawl biasing spring 8 within the body 1.

Figure 9:
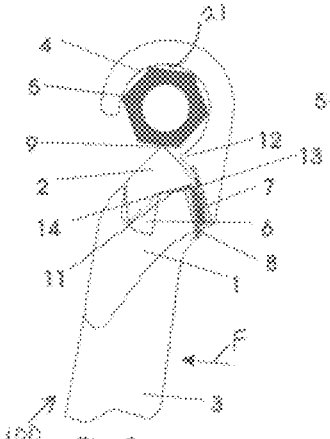
FIG. 9 is the tool of FIG. 8 showing the tool rotated to manipulate the hardware.
Figure 10:
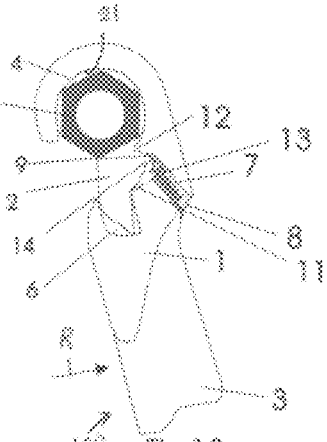
FIG. 10 is the tool of FIG. 9 showing reverse rotation of the tool in its release or ratcheting stroke.

As illustrated in FIG. 10, in operation, the tool 100 is initially positioned upon the hardware 5 and; with a slight reversal of the handle 3, the pawl 2 is driven open as to allow the tool 100 to find position over the hardware 5. As shown in FIGS. 8-9 and 12-14, at this point the pawl 2 establishes initial contact 9 with the hardware 5 via pivoting action, which pivoting action is shown in the drawings by the arrow associate with the numeral 10. The pivoting action 10 is aided by spring-load provided by the pawl biasing spring 8. This pivoting action 10 creates a wedging effect of the pawl 2 against the hardware 5. At this point, a geometrical relationship is established between the point of contact or tip 9 of the pawl 2 against the hardware 5 and the contact area of the base 11 of the pawl 2 which engages a corresponding surface of the void 6.

To rotate the hardware 5, a user draws forward upon the handle 3, as shown in FIG. 9 by arrow F. To be more specific, a user rotates the tool 100 around the hardware 5 in a clockwise manner. This is possible due the fact that the hardware enclosure 4 is round or circular. Thus, the tool 100 is free to rotate around the hardware 5 free of obstruction. This movement causes the pawl 2 to roll along its base 11 due to the previously described wedging aspect of the contacting tip 9 of the pawl 2 against the hardware 5. The geometry of all parts involved during this rolling action of the pawl 2 causes the contact point 9 against the hardware 5 to relocate, further pressing inward toward and against the hardware.

Figure 12:
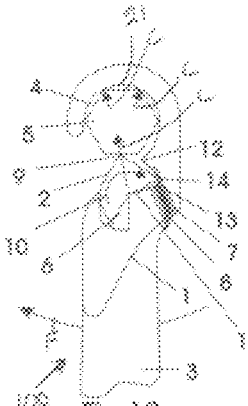
FIG. 12 is the tool of FIG. 8 illustrating relative geometry and resulting compression utilizing the basic configuration of this tool.
Figure 13:
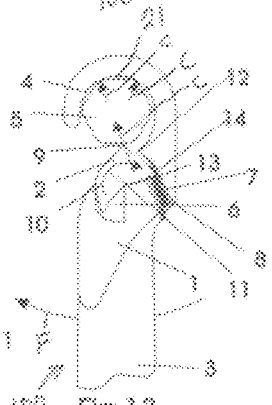
FIG. 13 is the tool of FIG. 8 illustrating dynamics as applied to worn or smaller hardware.
Figure 14:
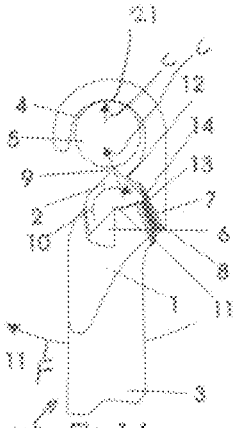
FIG. 14 is the tool of FIG. 8 illustrating application on completely rounded over hardware.
Figure 8:
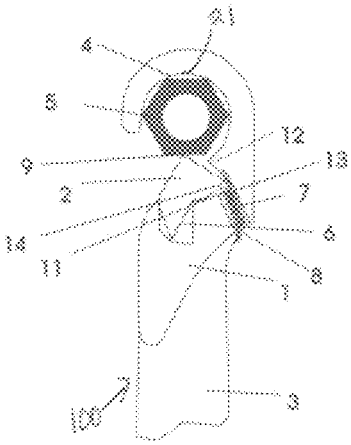
FIG. 8 is a partially cut away side view of the tool of FIG. 7 illustrating initial positioning over hex-hardware.

As illustrated in FIG. 12, thus an increasing compression aspect is established, forcing the hardware 5 against the inner radius of the partial enclosure 4 until such compression, which compression force is indicated by arrows C in FIGS. 12-14, and resulting friction is adequate to hold the hardware 5 in conjunction with the tool 100, at which point the tool 100 transfers such rotation to the hardware 5.

Upon satisfactory rotation of the hardware 5, the movement of the tool 100 is reversed, i.e. moved in a counterclockwise direction as illustrated in FIG. 10 by Arrow R, to relocate the tool 100 for another movement of the hardware 5 in a ratcheting action. This reversal of movement causes the pawl 2 to be relieved of its compression by collapsing the pivoting aspect readily achieved by the simple reversal of motion, due to the previously described constant off-center condition of the pawl 2. This reverse motion can continue without entraining the hardware 5 due to the light resistance delivered by the spring 8 that spring loads the pawl 2. Thus the pawl 2 is rolled back and pivoted over as shown in FIG. 10 until the contact point 9 of the pawl 2 escapes past the highest point of the hardware 5. The pawl 2 is then brought back to its engagement with the hardware 5 by way of the spring-load, whereby the process can be repeated. By repeatedly moving the wrench 100 back and forth in this manner, the hardware 5 may be located step by step toward a tightening condition.

To loosen the hardware 5, the wrench 100 is flipped over 180 degrees and applied in a reverse manner to the tightening direction that is illustrated in FIG. 9. The function of the tool 100 is basically the same to loosen the hardware 5 as when tightening the hardware 5, although the direction of manipulation is reversed.

Due the fact that this tool 100 engages or utilizes as a contact surface the outer circumference of the hardware 5 to maintain relative position of such hardware 5 as to function, worn hardware 5 with rounded over lobes as well as hardware manufactured with rounded lobes, due to a minimized outer circumference, find a gripping position further away from the pawl 2. As such, the initial pivoting action of the pawl 2 falls short of establishing contact with the hardware 5. This aspect is compensated by the spring 8 which is attached to a tang 14 provided on the pawl 2 and draws the pawl 2 into its compression phase, as illustrated in FIGS. 13 and 14. Thus the contact point 9 of the pawl 2 elevates or advances toward the hardware 5 until the necessary wedging aspect is achieved at which point the tool 100 functions normally.

Figure 16:
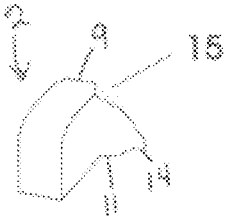
FIG. 16 is a perspective view of the tool's pawl which utilizes beveled edges.

Under severe torque demand, the pawl 2 may be forced to roll through its entire range of motion, at which point a stop 12 is provided in the body 1. The stop 12 is configured to maintain the off-center characteristic necessary for release of compression upon ratcheting. In this situation, under continued torque application, the stop 12 becomes a fulcrum against the pawl 2, and as such, the base 11 is in jeopardy of relocating or kicking out. Referring now to FIGS. 11 and 16, to prevent kicking out of the pawl 2 and to maintain the desired geometry, a notch 13 is provided in the pawl void 6 of the body 1 so that the notch is located at the end of the radius configuration. The notch 13 and a mating tang 14 fabricated in the base 11 of the pawl 2 function together to allow for positive positioning of the pawl 2 within the tool 100 to maintain functionality.

Due to the extreme upward pressure exerted against the upper surface 21 of the partial enclosure 4 of the hardware void 6, the open-end configuration 100 requires a suitable material to hold up against such pressure. The prototype utilized A-2 steel hardened to Rockwell 59 for both the body 1 and the pawl 2. The prototype was successful to the point of breaking the heads off of #8 hardened 7/16 bolts. Other material may be used as an economical consideration; however, a degree of hardness is necessary to maintain the condition of the contact point 9 of the pawl 2 as it relates directly to the function of the tool 100.

Figure 15:
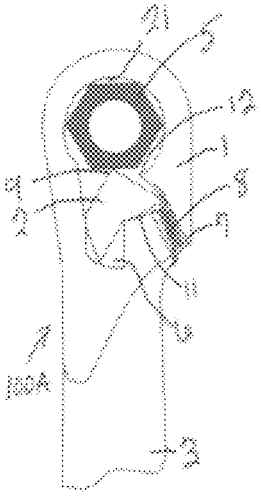
FIG. 15 is a partially cut away side view of an alternate embodiment tool with a closed end.

FIG. 15 shows an alternate tool 100A which is stronger than tool 100 because it is a closed end version or configuration. This alternate tool 100A would allow for softer metal in its fabrication. A narrower (thinner) version is also of consideration, although sacrificing some benefits of handling would result.

Referring also to FIG. 16, a beveled tip 15 of the pawl 2 aids in the initial application of the tool 100 or 100A over the hardware 5. As such the beveled tip 15 facilitates the act of opening the pawl 2 in its initial application, however this beveled tip 15 sacrifices contact point area, and thus detracts from its function.

Figure 17:
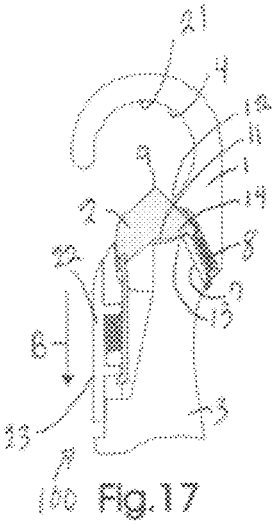
FIG. 17 is a partially cut away side view of a manually opening version of the tool of FIG. 8.

As shown in FIG. 17, to assist in the initial application of the tool 100 or 100A, an optional manually opener 22 may be provided. The opener 22 utilizes a spring activated thumb piece 23 with a connection to the pawl 2 that is configured to be independent of the action of the pawl 2 during operation of the tool 100 or 100A. To use, the thumb piece 23 is manually drawn down in the direction of Arrow B by the user, and as such, the connection with the pawl 2 pulls the pawl 2 in an opening manner as to provide clearance of the pawl 2 in relation to the hardware 5 to be manipulated, thus allowing the tool to be more readily installed upon the hardware 5.

Figure 18:
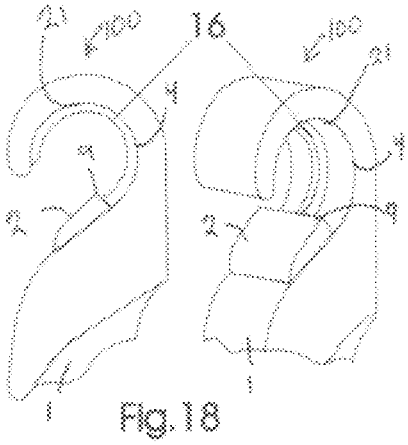
FIG. 18 is a side view and a perspective view of the tool of FIG. 7 shown equipped with a hardware guide ring.

FIG. 18 illustrates an optional center guide-ring 16, which is provided in the tool 100 or 100A on the inside of the tool within the partial enclosure 4 of the hardware void 6 or within the hardware void 6 for the alternate tool 100A. The center guide-ring 16 is possible due the thick configuration of the tool 100 or 100A which allows for a surface to maintain the hardware 5 within the hardware enclosure or void 6. The center guide-ring 16 functions to improve handling characteristics in both tightening and loosening situations.

Figure 19:
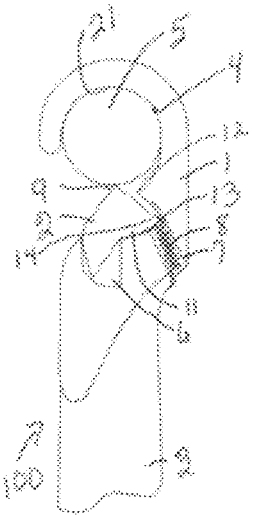
FIG. 19 is a partially cut away side view of the tool of FIG. 18 being used on round hardware.

FIG. 19 illustrates a configuration designed specific as to function on round material or hardware 5 by fabricating the hardware void 6 as to provide suitable guidance of the round hardware material 5, and also reconfiguring the positioning of the pawl 2 to allow correct location of the pawl 2, i.e. providing correct initial pivoting/wedging aspects which allows for the complete motion of the pawl 2 to take full advantage of the compression aspect.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A ratcheting wrench comprising:

a tool body having a handle at one end of the body for rotating the tool via ratcheting action and a curved enclosure at an opposite end of the body for receiving therein hardware to be rotated, the body having a void therein, a rolling pivoting pawl located within the void of the body, a pawl spring attached to the pawl biasing the pawl toward an opposing side of the curved enclosure, and said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring.

2. A ratcheting wrench according to claim 1 further comprising:

a stop provided on the body to engage the pawl and limit pivoting action of the pawl under severe torque conditions.

3. A ratcheting wrench according to claim 1 further comprising:

a notch in the void and a mating tang on the pawl collectively maintain the off-center characteristic of the pawl and prevent pawl kick out under severe torque demand.

4. A ratcheting wrench according to claim 1 further comprising:

said pawl spring attaching via a first end to a tang of the pawl and attaching via an opposite second end to the body of the tool to bias the pawl toward the curved enclosure.

5. A ratcheting wrench according to claim 1 wherein the curved enclosure is a closed ended circle for receiving hardware within the curved enclosure.

6. A ratcheting wrench according to claim 1 wherein the pawl is repositioning sufficiently close to the curved enclosure for use on round hardware.

7. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl located within the void of the body, a pawl spring attached to the pawl biasing the pawl toward the curved enclosure, said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring, and a beveled tip provided on the pawl for engaging hardware located within the curved enclosure.

8. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl located within the void of the body, a pawl spring attached to the pawl biasing the pawl toward the curved enclosure, and said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring wherein the curved enclosure is an open ended circle with an opening in its front to facilitate placing hardware within the curved enclosure.

9. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl located within the void of the body, a pawl spring attached to the pawl biasing the pawl toward the curved enclosure, said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring, an optional opener provided on the body and attaching to the pawl, and a spring actuated thumb piece for manually drawing the pawl into an open configuration.

10. A ratcheting wrench according to claim 9 wherein said opener does not interfere with the normal ratcheting function of the pawl.

11. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl located within the void of the body, a pawl spring attached to the pawl biasing the pawl toward the curved enclosure, said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring, and an optional center guide-ring provided on the inside of the hardware opening to position the tool relative to the hardware.

12. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl located within the void of the body, a pawl spring attached to the pawl biasing the pawl toward the curved enclosure, said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring, and said pawl spring contained within an aperture provided in the body such that the aperture communicates with the void in the body.

13. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl located within the void of the body, a pawl spring attached to the pawl biasing the pawl toward the curved enclosure, said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring, and a three pointed object having a base that engages a notch in the void, said object having a tang adjacent the base for attachment to the pawl spring, and said object having a contact point opposite the base for engaging hardware.

14. A ratcheting wrench comprising:

a tool body having a handle at one end of the body for rotating the tool via ratcheting action and a curved enclosure at an opposite end of the body for receiving therein hardware to be rotated, the body having a void therein, a pivoting pawl housed within the void of the body, a pawl spring attached to the pawl biasing the pawl toward the curved enclosure, said pawl constantly maintained in an off-center condition with a contact point of the pawl advancing toward the curved enclosure as the pawl pivots toward the spring and with the contact point of the pawl retracting from the curved enclosure as the pawl pivots away from the pawl spring, and outer shell hardware forming side walls for the void in the body that houses the pawl.

* * * * *